US005125569A

United States Patent [19]

Anderson et al.

[11] Patent Number: 5,125,569

[45] Date of Patent: Jun. 30, 1992

[54] GABLE TOP CARTON WITH EASY OPENING SEALED TOP AND BLANK THEREFOR

[75] Inventors: Nestor A. Anderson, Parsippany, N.J.; Paul N. Phillips, Olmsted Falls, Ohio

[73] Assignee: Champion International Corporation, Stamford, Conn.

[21] Appl. No.: 761,468

[22] Filed: Sep. 18, 1991

[51] Int. Cl.[5] ..... B65D 5/54

[52] U.S. Cl. ..... 229/214; 229/125.42; 229/216

[58] Field of Search ..... 229/125.42, 134, 138, 229/80, 213, 214, 216; 206/631.3, 631.2, 631.1, 631; 156/209, 219

[56] References Cited

U.S. PATENT DOCUMENTS

| | | | |
|---|---|---|---|
| 1,123,628 | 1/1915 | Van Wormer | 206/631.3 |
| 2,501,852 | 3/1950 | Ringler | 229/134 |
| 2,661,141 | 1/1953 | Zinn, Jr. | 206/631.3 |
| 2,723,936 | 11/1955 | Ryan | 156/209 |
| 3,017,067 | 1/1962 | Parks | 229/134 |
| 3,270,940 | 9/1966 | Egleston et al. | 206/631.3 |
| 3,446,685 | 5/1969 | Goldstone et al. | 156/209 |
| 3,508,991 | 4/1970 | Yunan | 156/209 |
| 3,746,244 | 7/1973 | Bergstein | 229/134 |
| 4,792,048 | 12/1988 | Wyberg | 229/125.42 |
| 4,946,041 | 8/1990 | Poole | 229/125.42 |

*Primary Examiner*—Stephen Marcus
*Assistant Examiner*—Christopher McDonald
*Attorney, Agent, or Firm*—Evelyn M. Sommer

[57] ABSTRACT

An easy opening gable top carton and a blank for forming such a carton are provided. A pair of interior top seal panels of the carton and adjacent areas of the exterior top seal panels are provided with arrays of seal score lines. The seal score lines are disposed to extend upwardly from the interior surface of the blank and will substantially reduce the surface area of contact between the interior top seal panels and the exterior top seal panels for facilitating the formation of the pour spout on the carton.

19 Claims, 2 Drawing Sheets

GABLE TOP CARTON WITH EASY OPENING SEALED TOP AND BLANK THEREFOR

BACKGROUND OF THE INVENTION

Gable top cartons are formed from a single sheet of paperboard material that is folded to define an upstanding side wall enclosure, a sealed bottom and an initially sealed top that is capable of being periodically opened and closed to access the material stored in the carton. The paperboard sheet or blank, from which the gable top carton is formed typically is coated or laminated on both sides with a plastic and/or may also include foil on one side to prevent the material stored in the carton from leaking and to prevent liquids from wicking into the paperboard material of the carton.

The side wall enclosure of the typical prior art gable top carton comprises a total of four rectangular side walls consecutively articulated to one another and disposed in opposed parallel pairs. One rectangular side wall is securely adhered by heat sealing to a side seam panel that is hingedly connected to an adjacent rectangular side wall panel. The bottom of the prior art gable top carton is defined by an array of bottom panels that are folded into overlapping relationship to one another and that are securely and substantially permanently sealed. The top of the prior art gable top carton includes a pair of rectangular roof panels that converge toward one another. Arrays of hingedly connected triangular panels extend between and connect the rectangular roof panels. Top seal panels are articulated to the rectangular roof panels and to the arrays of triangular panels. The top seal panels are secured in face to face relationship to seal the top of the prior art gable top carton.

The prior art gable top carton is opened by folding corner regions of the rectangular roof panels backwardly to more conveniently access one of the arrays of triangular panels extending therebetween. This first step of the carton opening generally can be carried out easily. The top seal panels of the triangular panels are then separated from the top seal panels of the rectangular roof panels, such that the triangular panels can be folded outwardly to define a pour spout. This second step of the prior art carton opening has presented difficulties as explained further below. The top of the prior art gable top carton can be reclosed by merely folding the triangular panels back inwardly such that the top seal panels again can be disposed in generally face to face relationship with one another. Re-openings and re-closings can be carried out as needed for further access to the materials stored in the carton.

The top opening region of the gable top carton has presented many design challenges to the container industry. In particular, all seams on the gable carton must be sufficiently secured to prevent leakage of material from the carton and to prevent spoilage or contamination of material stored in the carton. Heat sealing technology is sufficiently advanced to achieve a secure seal. In particular, the seals generally are achieved by applying heat and pressure to activate the heat seal coating for securely sealing the carton. However, in addition to being securely sealed, the pour spout of the gable carton top must also be easily openable. The functional differences between a permanently closed pour spout of a gable top carton and an easily openable pour spout are appreciated by all consumers who have inadvertently attempted to open the wrong side of a gable top carton or who have purchased one of the gable top carton where the easy opening feature was inadequate.

To facilitate the initial opening of the pour spout on the prior art gable top carton, selected regions of the top seal flaps typically are coated with an abhesive. The abhesive functions to at least partly minimize the effect of subsequently heat sealed flaps. Thus, regions of the pour spout on the prior art gable top are securely closed, but are intended to be openable with relative ease. A prior art gable top closure employing a water based abhesive is shown for example, in U.S. Pat. No. 4,775,096 which issued to Andersson et al on Oct. 4, 1988. Another prior art gable top carton that attempts to avoid abhesives by employing a specific combination of paperboard coatings and adhesive is shown in U.S. Pat. No. 4,903,891. The use of abhesive is considered undesirable in that it requires a separate precise coating step as part of the manufacturing process. An imprecise application of abhesive may affect the ability of the carton top to function as intended.

Despite the continued use of various abhesive, adhesive and paperboard coating combinations, there is a desire to provide a gable top carton having a pour spout that can be securely sealed, but which is predictably easily openable. One attempt to provide an easy opening pour spout with less reliance on complex combinations of abhesives, adhesives and coatings is shown in U.S. Pat. No. 4,828,539 which issued to Jonsson et al on May 9, 1989. U.S. Pat. No. 4,828,539 shows an array of very small diamond-shaped embossments being placed on regions of the various registered top seal panels that must be separated during opening to define the pour spout. This pattern of small raised surfaces is intended to achieve only limited regions of paperboard material to contact with the heating and pressure means for sealing the carton. The pattern of small embossments or raised surfaces taught by U.S. Pat. No. 4,828,539 still results in large contact areas for the sealing means, and hence does not adequately facilitate the initial carton opening. Furthermore, small embossments of one top seal panel must nest between embossments of an adjacent top seal panel to increase the contact area.

In view of the above, it is an object of the subject invention to provide a gable top carton having an easy opening pour spout.

It is another object of the subject invention to provide a gable top carton with a closure that does not rely exclusively upon combinations of abhesive and adhesive for facilitating the initial carton opening.

An additional object of the subject invention is to provide a gable top carton with efficient sealing and with predictable easy opening in the region of the pour spout.

SUMMARY OF THE INVENTION

The subject invention is directed to a gable top carton and to a blank of paperboard material for forming a carton. The paperboard blank may be provided with a plastic or foil coating or laminate on one and/or both sides to render the paperboard material substantially impervious to liquids and/or gas. The blank is further provided with an array of score lines which define a corresponding array of hingedly connected panels and flaps. Adjacent panels and/or flaps may be articulated relative to one another about the score lines during the erection of the carton. Selected panels or flaps may be provided with a coating for enabling the carton to be securely and sealingly retained in its erected condition.

The panels of the blank include at least one side wall panel which may be formed into an upstanding side wall enclosure on the carton erected from the blank. The blank further includes at least one bottom wall panel articulated to the side wall panel for defining a sealed bottom on the carton erected from the blank.

The blank of the subject invention further includes first through fourth top panels hingedly connected to the portions of the blank that will define the upstanding side walls of the carton. The first and third top panels are substantially rectangular, while the second and fourth top panels are of substantially isosceles triangular configuration. Triangular web panels are hingedly connected to and extend between the respective first through fourth top panels. Top seal panels are articulated to the first and third rectangular top panels and to the triangular web panels.

One of the isosceles triangular top panels along with the triangular web panels articulated thereto and adjacent corners of the rectangular top panels define a re-closable pour spout for the carton. In particular, the re-closable pour spout may be selectively opened and re-closed to access the material stored in the carton formed from the blank. This pour spout, however, must initially be securely sealed to prevent leakage or spoilage of the material in the carton and must be easily openable from this initially sealed condition. To facilitate the initial opening without the use of abhesives, selected top seal panels on or adjacent to the pour spout are characterized by an array of seal score lines thereon. Selected seal score lines in the array may be parallel to one another. Additionally, in a preferred embodiment described in greater detail below, the array of seal score lines may define a first plurality of parallel seal score lines and a second plurality of parallel seal score lines intersecting the seal score lines in the first plurality. Thus, the seal score lines may define a pattern of X's extending across selected top seal panels of the blank. The width of each seal score line and the distance between adjacent parallel seal score lines may vary in accordance with the preferred sealing strength of the top seal panels on the carton. Preferably, however, the seal score lines define a width that is small as compared to the distance between adjacent parallel seal score lines. Additionally, on embodiments defining the pattern of X's on the top seal panels, the distance between parallel seal score lines is such that a relatively small number of seal score lines intersections will be disposed across the top seal panels.

The blank of the subject invention is formed into a carton by initially forming the side wall enclosure and sealing the bottom of the carton. The carton may be filled with the appropriate material, and the top may then be closed and sealed. The closure of the gable carton top is carried out by first rotating the triangular top wall panels inwardly and toward one another. The rectangular top wall panels similarly are rotated toward one another and over the triangular top wall panels. The top seal panels then are secured to one another to close the top of the carton. Regions of the top seal panels having the seal score lines thereon will be an abutting face to face contact with an adjacent top seal panel. However, regions intermediate the seal score lines will be slightly spaced from the planar regions of the adjacent panel. Thus, a relatively small surface area of contact between adjacent top seal panels is achieved with a correspondingly low force required to open the carton top. The required opening force can be carefully controlled by the width of each respective seal score line and the spacing between adjacent seal score lines. Seal score lines that are parallel to one another on the unfolded blank will intersect one another when folded into face to face contact on the carton erected from the blank. Thus, a nesting of seal score lines, as existed with prior art cartons, will not occur with the subject carton. Embodiments with intersecting seal score lines defining a pattern of X's or parallel lines across selected top seal panels will further ensure that no channels exist across the top seal through which material could leak.

In certain embodiments, as explained further herein, the seal score lines are disposed on all seal panels which define the reclosable pour spout. In these embodiments an array of seal score lines on one seal panel will abut an array of seal score lines on an adjacent seal panel such that a plurality of points of abutting engagement are achieved. In other embodiments, however, seal score lines are disposed on only two of the seal panels defining the pour spout. In these embodiments the seal score lines of one seal panel will be in abutting face to face relationship with a substantially planar top seal panel. Thus, lines of abutting engagement will be achieved as opposed to points of abutting engagement in the previous embodiment.

DETAILED DESCRIPTION OF THE PREFERRED EMBODIMENTS

Figure 1:
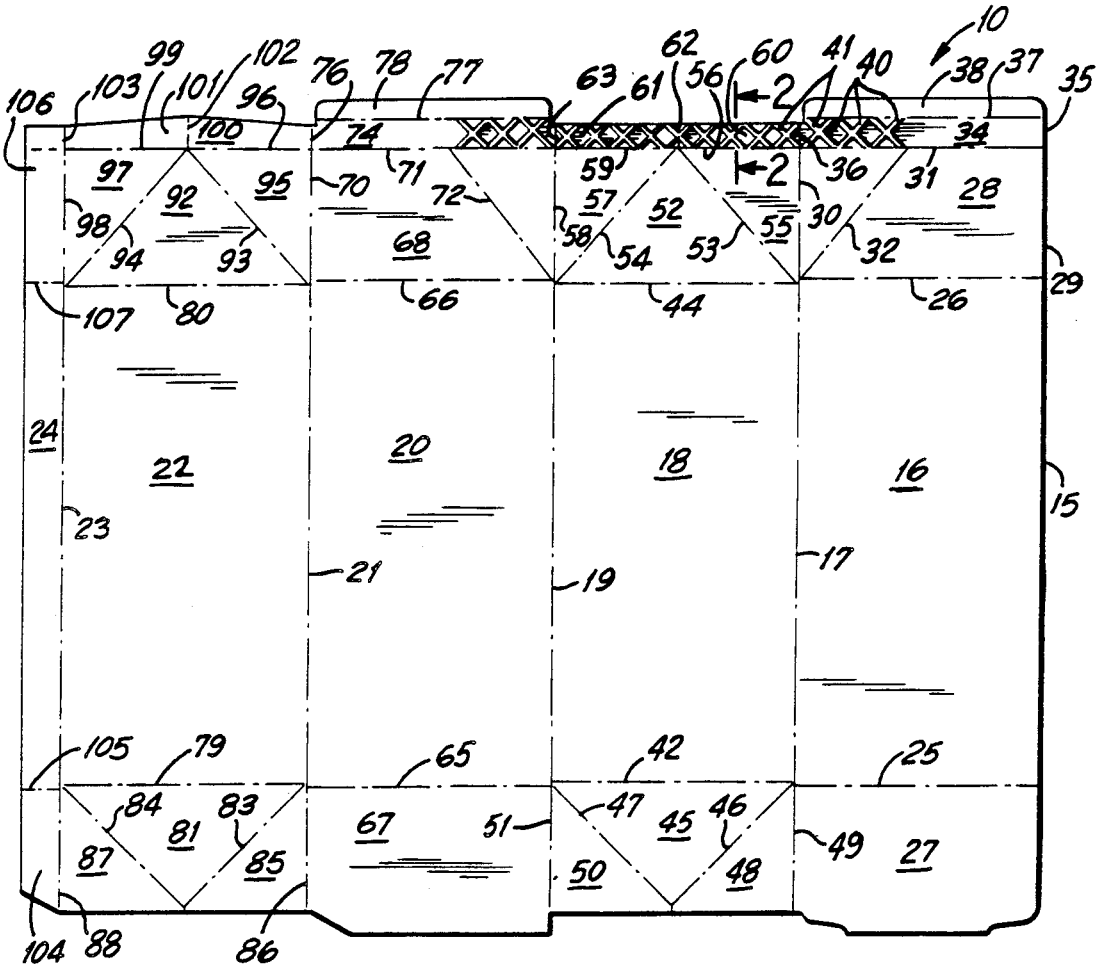
FIG. 1 is a plan view of a paperboard blank in accordance with the subject invention.
Figure 2:
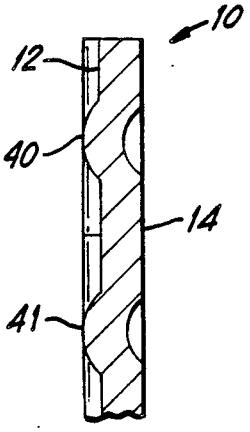
FIG. 2 is a cross-section taken along line 2—2 in FIG. 1.

The blank of the subject invention is identified generally by the numeral 10 in FIGS. 1 and 2. The blank 10 is formed from a unitary piece of paperboard material. A first surface 12, as shown in FIGS. 1 and 2 will define the interior of the carton formed from the blank 10. An opposed surface 14, as shown in FIG. 2, will define the exterior of the carton. The surface 12 and/or the surface 14 of the blank 10 may be coated or laminated with a plastic and/or foil material to render the blank substantially impermeable to at least selected liquids and/or gases. The particular coating or laminate material applied to the paperboard blank will be selected in accordance with the material to be stored in the carton formed from the blank 10 and in accordance with the anticipated environment in which the carton may be stored.

As shown most clearly in FIG. 1, the blank 10 is provided with an array of score lines or fold lines for defining a plurality of hingedly connected panels. In particular, the blank 10 includes a rectangular first side panel 16, a rectangular second side panel 18, a rectangular third side panel 20, a rectangular fourth side panel 22, and a rectangular side seam panel 24 which are consecutively articulated to one another along parallel fold lines 17, 19, 21 and 23 respectively.

The first side panel 16 is further defined by an edge 15 which extends parallel to the fold line 17. Additionally, the first side panel 16 is defined by a first bottom fold line 25 and a first top fold line 26. A first bottom panel 27 is articulated to the first side panel 16 along the first bottom fold line 25.

A rectangular first top panel 28 is articulated to the first side panel 16 along the first top fold line 26. The rectangular first top panel 28 also is defined by side edge 29 which extends collinearly from the edge 15 of the first side panel 16. The rectangular first top panel 28 is further defined by fold line 30 extending substantially collinearly from the fold line 17 and by fold line 31 extending between the edge 29 and the fold line 30 and substantially parallel to the first top fold line 26. A pour spout score line 32 extends diagonally from the intersection of the fold lines 26 and 30 to a point along the fold line 31 intermediate its length. The triangular corner defined by the pour spout score line 32 on the rectangular first top panel 28 will define a portion of the pour spout on the gable carton as described further below.

A first exterior top seal panel 34 is articulated to the rectangular first top panel 28 along fold linè 31. The first exterior top seal panel 34 is further defined by edge 35 which extends collinearly from the edge 29 and by fold line 36 which extends collinearly from the fold line 30. Additionally, the first exterior top seal panel 34 is defined by a fold line 37 extending substantially parallel to the fold line 31 and between the edge 35 and the fold line 36. A first top seal flap 38 is articulated to the first exterior top seal panel 34 along the fold line 37. The first exterior top seal panel 34 is characterized by a first array of parallel seal score lines 40 and a second array of parallel seal score lines 41 disposed such that each seal score line 40 intersects a seal score line 41 at a location approximately midway between the fold lines 31 and 37. Additionally, each seal score line 40 intersects a seal score line 41 substantially at the fold line 34 and intersects a different seal score line 41 substantially at the fold line 37. Thus, as illustrated clearly in FIG. 1, the array of seal score lines 40 and the array of seal score lines 41 effectively defines a pattern of X's extending partly across the first exterior top seal panel 34. More particularly, the seal score lines 40 and 41 are disposed from a location in proximity to the fold line 36 to a location approximately in line with the intersection of the pour spout score line 32 with the fold line 31. As shown in FIG. 2, the seal score lines 40 and 41 on the first exterior top seal panel 34 are disposed to extend outwardly from the plane defined by the surface 12 of the blank 10 which will define the interior of the carton formed from the blank 10. Each seal score line 40, 41 defines a width substantially less than the distance between the adjacent parallel seal score line 40, 41. In particular, the width of each seal score line 40, 41 preferably is between 10–25% the center-to-center spacing between adjacent parallel seal score lines 40, 41. In particular, a seal score line 40, 41 may define a width of approximately 2 mm. with a center-to-center spacing of approximately 8 mm. between adjacent parallel seal score lines 40, 41.

The second side panel 18 of the blank 10 is further defined by a second bottom fold line 42 and a second top fold line 44. An isosceles triangular second bottom panel 45 is articulated to the second bottom panel 18 along the second bottom fold line 42. The triangular second bottom panel 45 is further defined by converging fold lines 46 and 47. A triangular bottom web panel 48 is articulated to the first bottom panel 27 along fold line 49 and to the second bottom panel 45 along fold line 46. Similarly, a triangular bottom web panel 50 is articulated to the second bottom panel 45 along fold line 47, and is further defined by fold line 51 extending collinearly from the fold line 19.

An isosceles triangular second top panel 52 is articulated to the second side panel 18 along the second top fold line 44. The triangular second top panel 52 will define a major portion of the pour spout on the carton formed from the blank 10. The triangular second top panel 52 is further defined by converging fold lines 53 and 54. A triangular first top web panel 55 is articulated to the rectangular first top panel 28 along fold line 30 and to the triangular second top panel 52 along fold line 53. The triangular first top web panel 55 is further defined by fold line 56 which extends substantially collinearly from the fold line 31 and parallel to the second top fold line 44. Similarly, a triangular second top web panel 57 is articulated to the triangular second top panel 52 along fold line 54. The triangular second top web panel 57 is further defined by fold line 58 which extends collinearly from the fold line 19, and by fold line 59 which extends collinearly from the fold line 56.

A first top interior top seal panel 60 is articulated to the triangular web first top panel 55 along the fold line 56 and is further articulated to the first top exterior seal panel 34 along fold line 36. A second interior top seal panel 61 is articulated to the triangular second top web panel 57 along the fold line 59. The second interior top seal panel 61 is articulated to the first interior top seal panel 60 along fold line 62 and is further defined by fold line 63 extending collinearly from the fold line 58. The arrays of score lines 40 and 41 described above continue from the first exterior top seal panel 34 substantially across the first and second interior top seal panels 60 and 61. The width and spacing between the respective score lines 40, 41 is substantially uniform.

The third side panel 20 is further defined by a third bottom fold line 65 and a third top fold line 66 which extend orthogonally between the fold lines 19 and 21 respectively. A third bottom panel 67 is articulated to the third side panel 20 along the third bottom fold line 65. The third bottom panel 67 is articulated to the bottom web panel 50 along fold line 51, and is further defined by fold line 86.

A rectangular third top panel 68 is articulated to the third side panel 20 along the third top fold line 66. The third top panel 68 is articulated to the triangular second top web panel 57 along fold line 58. The third top panel 68 is further defined by fold line 70 extending generally collinearly from the fold line 21 and by fold line 7 extending generally parallel to the third top fold line 66 and orthogonally between the fold lines 58 and 70. The third top panel 68 is further characterized by a pour spout score line 72 which extends diagonally from the intersection of fold lines 58 and 66 to a point intermediate the length of the fold line 71. The pour spout score line 72 on the third top panel 68 generally corresponds to the pour spout score line 32 on the first top panel 28. Thus, the corner of the rectangular third top panel 68 defined by the pour spout score line 72 will define a portion of the pour spout on the carton formed from the blank 10, as explained further below.

A second exterior top seal panel 74 is articulated to the third top panel 68 along the fold line 71. The second exterior top seal panel 74 is articulated to the second interior top seal panel 61 along the fold line 63. The second exterior top seal panel 74 is further defined by fold line 76 extending generally collinearly from the fold line 70 and by fold line 77 extending generally parallel to the fold line 71. A second top seal flap 78 is articulated to the second exterior top seal panel 74 along the fold line 77 and will be adhered in face to face contact with the first top seal flap 38 on the carton erected from the blank 10. The second exterior top seal panel 74 is characterized by a continuation of the score lines 40 and 41 as explained above. More particularly, the score lines 40 and 41 continue generally from the fold line 63 to a point along the second exterior top seal panel 74 generally in line with the intersection of the diagonal pour spout score line 72 with the fold line 71.

The fourth side panel 22 is further defined by a fourth bottom fold line 79 and a fourth top fold line 80. A triangular fourth bottom panel 81 is articulated to the fourth side panel 22 along the fourth bottom fold line 79. The fourth bottom panel 81 is triangular in shape, and is further defined by converging fold lines 83 and 84. A triangular web panel 85 is articulated to the fourth bottom panel 81 along the fold line 83 and is further articulated to the third bottom panel 67 along fold line 86. Similarly, a triangular web panel 87 is articulated to the fourth bottom panel 81 along fold line 84 and is further defined by fold line 88.

A triangular fourth top panel 92 is articulated to the fourth side panel 22 along the fourth top fold line 80. The fourth top panel 92 generally corresponds to the second top panel 52, but is not intended to be opened into a pour spout as explained further below. The fourth top panel 92 is further defined by converging fold lines 93 and 94.

A triangular third top web panel 95 is articulated to the third top panel 68 along fold line 70 and to the fourth top panel 92 along fold line 93. The triangular third top web panel 95 is further defined by fold line 96 which extends generally collinearly from the fold line 71. A triangular fourth top web panel 97 is articulated to the fourth top panel 92 along fold line 94. The triangular fourth top web panel 97 is further defined by fold line 98 which extends generally collinearly from the fold line 23, and by fold line 99 which extends collinearly from the fold line 96. Third and fourth interior top seal panels 100 and 101 are articulated to the triangular web panels 95 and 97 along fold lines 96 and 99 respectively. The third interior top seal panel 100 is articulated to the second exterior top seal panel 74 along fold line 76 and is articulated to the fourth interior top seal panel 101 along fold line 102. The fourth interior top seal panel 101 is further defined by fold line 103.

A bottom seal panel 104 is articulated to the side seam panel 24 along fold line 105 and to the triangular bottom web panel 87 along fold line 88. Similarly, a top seal panel 106 is articulated to the side seam panel 24 along fold line 107 and to the triangular fourth top web panel 97 along fold line 98.

As noted above, one or both opposed sides 12 and 14 of the blank 10 may be coated or laminated with an appropriate plastic, foil or the like to achieve sufficient impermeability. Additionally, selected regions of the panels may have heat and/or pressure applied thereto for subsequent sealing during formation of the blank 10 into the carton 110 depicted in FIGS. 3 and 4. Unlike prior art containers, the blank 10 would not need an abhesive material applied to regions of the blank that will define the easy opening pour spout of the carton 110.

The blank 10 is formed into the carton 110 in substantially the conventional manner by rotating the side panels 16, 18, 20 and 22 about the respective fold lines 17, 19, 21 and 23. The side seam panel 24 and the bottom and top seal panels 104 and 106 are then adhered respectively to the first side panel 16, the first bottom panel 27 and the first top panel 28 on regions thereof generally adjacent the side edges of the blank 10. The blank may be collapsed and shipped in this partly formed condition from the paperboard manufacturer to the dairy or other such location where the blank will be further formed, filled and sealed as explained herein. In particular, the blank is further formed in the conventional manner by expanding the collapsed partly formed structure and rotating the bottom panels 27, 45, 67 and 81 inwardly. The bottom of the carton 110 is then sealed in a conventional matter by appropriate application of heat and pressure. The resulting structure has an open top for receiving the material to be stored in the carton 110. Final sealing of the carton 110 is achieved by rotating the isosceles triangular second and fourth top panels 52 and 92 inwardly, and subsequently rotating the first and third rectangular top panels 28 and 68 inwardly. Heat and pressure is then applied to the exterior top seal panels 34 and 74 to initiate the seal. In this closed condition, regions of the exterior surface 14 on the first and second interior top seal panels 60 and 61 are disclosed in face to face relationship with one another. Regions of the interior surface 12 on the first and second interior top seal panels 60 and 61 will be disposed in generally face to face relationship with opposed regions of interior surface 12 of the first and second exterior top seal panels 34 and 74. In a similar manner, the interior seal panels 100 and 101 will be folded and secured tightly in face to face relationship between regions of the interior surface 14 on the exterior top seal panels 34 and 74 respectively.

Figure 3:
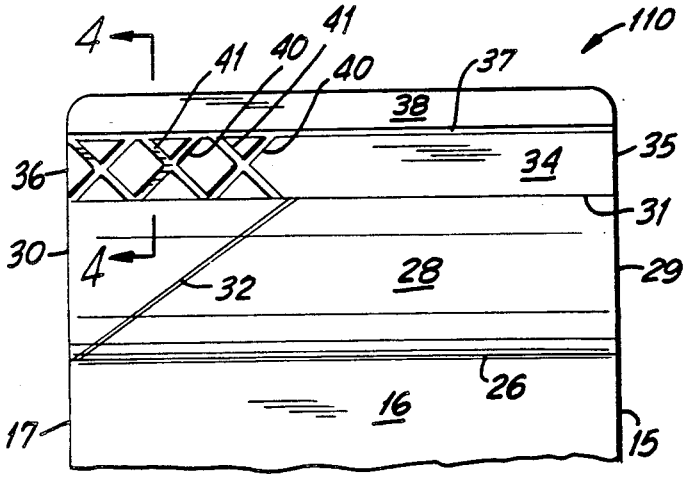
FIG. 3 is a side elevational view of a top portion of a carton formed from the blank of FIG. 1.
Figure 4:
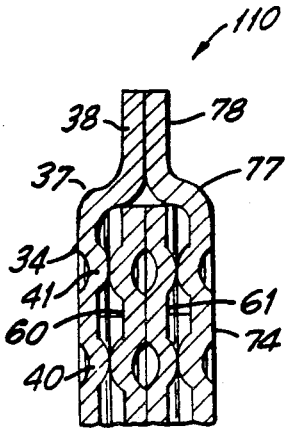
FIG. 4 is a cross-sectional view taken along line 4—4 in FIG. 3.

As explained above, the seal score lines 40 and 41 are disposed to extend upwardly from the interior surface 12 of the interior top seal panel 60 and 61 and regions of the exterior top seal panels 34 and 74 in proximity to the interior top seal panels 60 and 61. This extension of the score lines 40 and 41 from the interior surface 12 of the blank 10 will cause the diagonally aligned seal score lines 40 and 41 on the first exterior top seal panel 34 to intersect and contact the seal score lines 40 and 41 on the first interior top seal panel 60 at a plurality of discreet points as shown in FIG. 4. Similarly, the diagonally aligned seal score lines 40 and 41 on the second exterior top seal panel 74 will intersect and abut the seal score lines 40 and 41 on the second interior top seal panel 61 at a plurality of discreet points. These discrete points of contact between opposed intersecting regions of the seal score lines 40 and 41 will achieve a relatively small surface area of contact therebetween, with a correspondingly low force required to separate the adhesive applied thereto during opening of the pour spout. Regions of the exterior surface 14 on the first and second interior top seal panels 60 and 61 also will be disposed in generally face to face contact, but will define a substantially larger surface area in view of the directional orientation, dimensions and spacing between the various seal score lines 40 and 41. Thus, a more secure seal will be achieved between the first and second interior top seal panels 60 and 61. Similarly, the top seal flaps 38 and 78 are not scored and will be secured in direct abutting face to face relationship with one another as shown in FIG. 4. The carton 110 depicted in FIGS. 3 and 4 is opened by initially folding the corners of the first and third top panels 28 and 68 outwardly and away from one another about the respective pour spout score lines 32 and 72. This will cause the separation of the securely adhered interior top seal panels 60 and 61 and the securely adhered top seal flaps 38 and 78 from one another. However, this initial separation can be achieved relatively easily in view of the convenient access to the first and second triangular top web panels 55 and 57 defining a portion of the pour spout. The second phase of the carton opening would normally be more difficult in the prior art carton in view of the inability to access interior surfaces adjacent the panels being separated. However, as explained above, the interior top seal panels 60 and 61 are secured to the opposed surface regions of the exterior top seal panels 34 and 74 at only a plurality of discrete points defined by the intersecting score lines 40 and 41 and hence a relatively low separation force is required in view of the small surface areas of contact.

Figure 5:
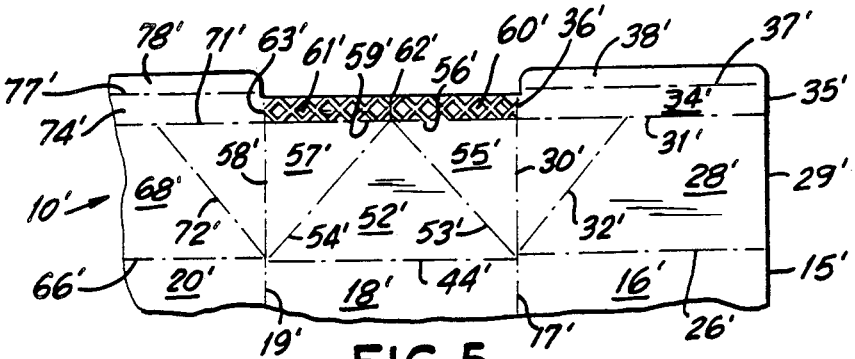
FIG. 5 is a top plan view of a portion of an alternate blank.
Figure 6:
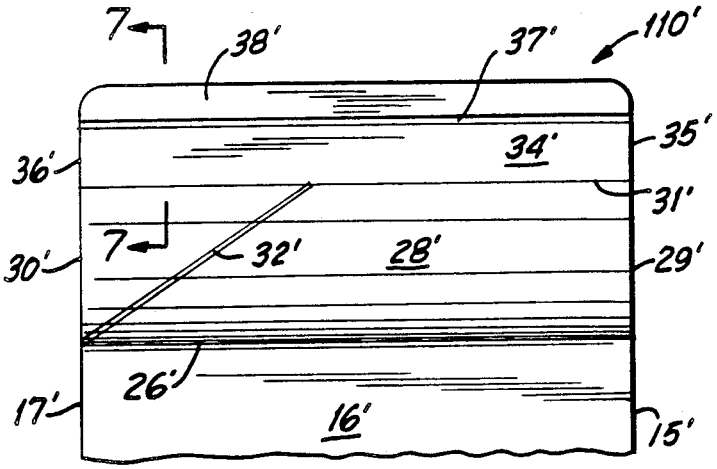
FIG. 6 is a side elevational view of a top portion of a carton formed with the blank of FIG. 5.
Figure 7:
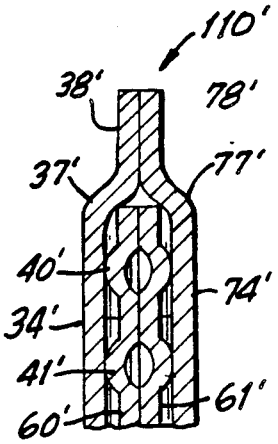
FIG. 7 is a cross-sectional view taken along line 7—7 in FIG. 6.

As explained above, the opening forces necessary to achieve the normally difficult second phase of opening the gable carton top may be altered by changing the width of the score lines 40 and 41 and/or the spacing therebetween. Still further variations in opening force can be achieved by altering the extent over which the score lines 40 and 41 are disposed. In this regard, alternate blank 10' is shown in FIG. 5. The blank 10' is similar to the blank 10 depicted in FIG. I above, and similar numerals are employed throughout. However, the seal score lines 40' and 41' are disposed to extend only on the interior top seal panels 60' and 61' and not on adjacent portions of the exterior top seal panels 34' and 74'. The blank 10' is formed, filled and sealed in the manner described above to define the carton 110' depicted in FIGS. 6 and 7. With this construction, the seal score lines 40' and 41' will define lines of contact with opposed planar surfaces of the exterior top seal panels 34' and 74'. This construction will achieve larger surface areas and hence higher required separation forces then the previously described embodiment which had points of contact between the respective interior and exterior top seal panels. However, the opening forces for the carton 110' will still be relatively low without the need to separately apply abhesive coatings. Similar effects can be achieved employing parallel nonintersecting score lines.

In summary, a gable carton is provided with top seal panels having arrays of top seal score lines disposed on regions of the top seal panels that will define the pour spout of the carton. The seal score lines substantially reduce the surface area of contact between the interior top seal panels and the opposed exterior top seal panels that will define the pour spout, and hence substantially reduce the forces required to complete the difficult second phase of opening the gable top pour spout wherein the interior top seal panels are separated from the exterior top seal panels. The seal score lines may be disposed to prevent opposed seal score lines from nesting with one another in a manner that could otherwise increase the surface area of contact. The required opening forces can readily be controlled by altering dimensions of seal score lines, spacings between seal score lines and relative regions on the top seal panels along which the seal score lines are disposed.

While the invention has been described with respect to a preferred embodiment, it is apparent that various changes can be made without departing from the scope of the invention as defined by the appended claims.

I claim:

1. A blank for forming an easy opening gable top carton, said blank being formed from a unitary piece of paperboard material and comprising: rectangular first, second, third and fourth side panels consecutively articulated to one another along parallel fold lines; first, second, third and fourth bottom panels articulated respectively to the first, second, third and fourth side panels along bottom fold lines; a rectangular first top panel articulated to the first side panel along a first top fold line; a triangular second top panel articulated to the second side panel along a second top fold line; a rectangular third top panel articulated to the third side panel along a third top fold line and a triangular fourth top panel articulated to the fourth side panel along a fourth top fold line; a first triangular web panel extending between and hingedly connected to the first and second top panels; a second triangular web panel extending between and hingedly connected to the second and third top panels; a first exterior top seal panel articulated to the first top panel along a fold line extending generally parallel to the first top fold line; first and second interior top seal panel articulated respectively to the first and second triangular web panels along fold lines extending generally parallel to the second top fold line, the first interior top seal panel being articulated to the first exterior top seal panel, and to the second interior top seal panel; a second exterior top seal panel articulated to the third top panel along a fold line extending generally parallel to the third top fold line, and being articulated to the second interior top seal panel; the blank further comprising at least a first array of generally parallel seal score lines disposed in at least the first and second interior top seal panels.

2. A blank as in claim 1 defining first and second opposed surfaces, the first surface defining the surface of the blank to define the interior of the gable carton formed from the blank, the seal score lines being disposed to extend from the first surface.

3. A blank as in claim 2 comprising a second array of parallel seal score lines disposed at least on the first and second interior top seal panels and aligned to intersect the seal score lines in the first array.

4. A blank as in claim 3, wherein the first and second interior top seal panels are further defined by top edges extending generally parallel to the second top fold line, each said seal score line in the first array intersecting a score line in the second array at a location substantially mid-way between the top edges of the respective first and second interior top seal panels and the fold lines articulating the first and second interior top seal panels to the respective first and second triangular web panels.

5. A blank as in claim 4, wherein each seal score line in the first array further intersects a seal score line in the second array at a location substantially adjacent the top edges of the first and second interior top seal panels.

6. A blank as in claim 4 where each seal score line in the first array further intersects a seal score line in the second array at a location substantially adjacent to the foldable connections of the first and second interior top seal panels to the respective first and second triangular web panels.

7. A blank as in claim 1, wherein the array of seal score lines extends to portions of the first and second exterior top seal panels in proximity to the respective first and second interior top seal panels.

8. A blank as in claim 7, wherein the first top panel is further characterized by a pour spout score line extending from a location adjacent the second side panel to a location along the articulation between the first top panel and the first exterior top seal panel, the third top panel being characterized by a pour spout score line extending from a location generally adjacent the second side panel to a location intermediate the length of the articulation between the third top panel and the second exterior top seal panel, the array of seal score lines extending to locations on the first and second exterior top seal panels substantially aligned with the intersections of the pour spout score lines with the respective first and second exterior top seal panels.

9. A blank as in claim 1, wherein the width of each seal score line is between approximately 1.0 and 2.5 mm.

10. A blank as in claim 1, wherein the width of each seal score line is approximately equal to between 10% and 25% of the center-to-center spacing between the score lines in the array.

11. A blank as in claim 1, wherein each said seal score line is aligned to define an acute angle relative to the second top fold line.

12. An easy opening gable top carton comprising an upstanding side wall enclosure, a sealed bottom and a gable top, said gable top being defined by an opposed pair of triangular top walls articulated to opposed locations on the upstanding side wall enclosure and converging toward one another, a pair of opposed rectangular top walls articulated to opposed locations on the upstanding side wall enclosure and converging toward one another and into generally overlying relationship with the triangular top walls, first through fourth triangular web panels extending between and hingedly connecting the respective triangular top walls to the rectangular top walls, first through fourth interior top seal panels articulated to locations on the first through fourth triangular web panels remote from the side wall enclosure of the carton, said first and second interior top seal panels being in face to face contact, first and second exterior top seal panels articulated to locations on the respective rectangular top walls remote from the side wall enclosure and in overlapping face to face relationship with the first through fourth second interior top seal panels, the first and second interior top seal panels being characterized by at least a first array of parallel seal score lines, the seal score lines extending from the first and second interior top seal panels toward the respective first and second exterior top seal panels, the seal score lines achieving relatively low contact area between each of the first and second interior top seal panels and the respective first and second exterior top seal panels.

13. A carton as in claim 12, wherein the first and second exterior top seal panels are characterized by a first array of parallel seal score lines aligned to intersect the seal score lines on the respective first and second interior top seal panels to achieve a plurality of discrete points of contact between the first and second interior top seal panels and the first and second exterior top seal panels.

14. A carton as in claim 12 comprising first and second arrays of parallel seal score lines, the seal score lines in the first array intersecting the seal score lines in the second array.

15. A carton as in claim 14, wherein each seal score line in the first array intersects no more than three seal score lines in the second array.

16. A carton as in claim 12, wherein each seal score line defines a width equal to 10%–25% of the center-to-center spacing between the parallel seal score lines.

17. A carton as in claim 12, wherein each said seal score line defines a width of approximately 1 mm.

18. A carton as in claim 12, wherein the first and second exterior top seal panels and the first and second interior top seal panels are substantially free of abhesive.

19. A carton as in claim 12, wherein the seal score lines are angularly aligned to the articulation between the first interior top seal panel and the first triangular web panel.

* * * * *